US006973855B2

(12) United States Patent
Yanosaka et al.

(10) Patent No.: US 6,973,855 B2
(45) Date of Patent: Dec. 13, 2005

(54) METHOD FOR MANUFACTURING HAIR CLIPPER BLADE

(75) Inventors: Masami Yanosaka, Hikone (JP); Yoshifumi Nishimura, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 195 days.

(21) Appl. No.: 10/418,110

(22) Filed: Apr. 18, 2003

(65) Prior Publication Data

US 2004/0016128 A1 Jan. 29, 2004

(30) Foreign Application Priority Data

Apr. 19, 2002 (JP) ..... 2002-118241

(51) Int. Cl.[7] ..... B26B 19/06; B26D 19/20

(52) U.S. Cl. ..... 76/101.1; 30/195; 30/205; 30/355

(58) Field of Search ..... 76/101.1, 104.1, 76/119, DIG. 8, DIG. 9; 30/30, 195, 208, 30/355

(56) References Cited

U.S. PATENT DOCUMENTS

| | | | | |
|---|---|---|---|---|
| 3,682,021 | A * | 8/1972 | Haban | 76/101.1 |
| 3,797,110 | A * | 3/1974 | Michelson | 30/82 |
| 5,600,890 | A | 2/1997 | Leitner et al. | |

FOREIGN PATENT DOCUMENTS

| | | |
|---|---|---|
| EP | 1 354 674 | 10/2003 |
| FR | 2789928 | 8/2000 |
| JP | 52-62555 | 5/1977 |
| JP | 64-49596 | 2/1989 |

* cited by examiner

*Primary Examiner*—Charles Goodman
(74) *Attorney, Agent, or Firm*—Oblon, Spivak, McClelland, Maier & Neustadt, P.C.

(57) ABSTRACT

A method for manufacturing a hair clipper blade includes providing a blank with a comb teeth shaped cutting edge portion, and forging the cutting edge portion to have an acute tip angle.

14 Claims, 21 Drawing Sheets

2, 3
VII (a)
VII (a)
VII (b)
VII (b)
4'
4'
VII (c)
VII (c)
4
4

20
10
4'
4
X (a)
X (b)

Fig. 17
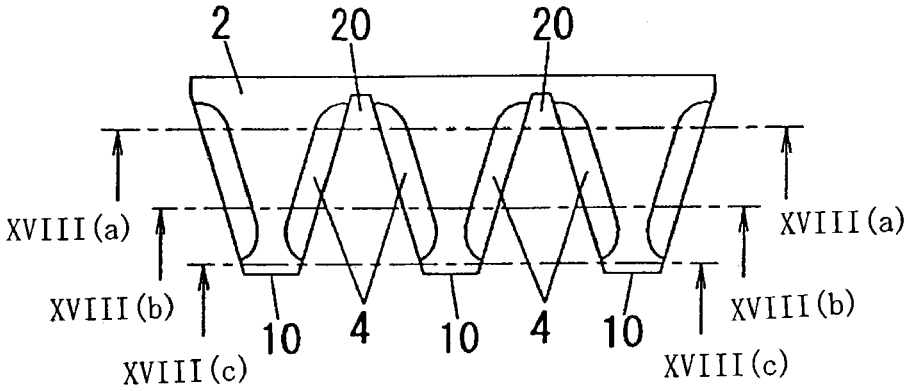
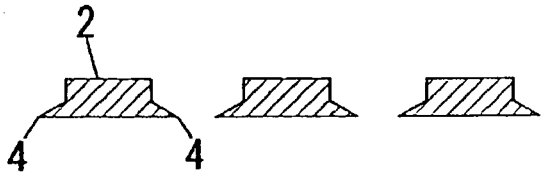
Fig. 18(a)
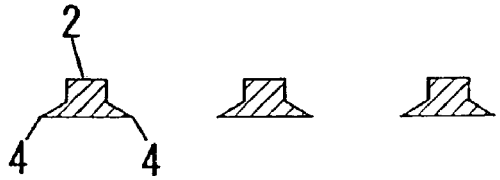
Fig. 18(b)
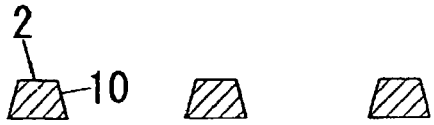
Fig. 18(c)

BACKGROUND ART

BACKGROUND ART

METHOD FOR MANUFACTURING HAIR CLIPPER BLADE

CROSS-REFERENCE TO RELATED APPLICATIONS

The present application claims priority under 35 U.S.C. §119 to Japanese Patent Application No. 2002-118241, filed Apr. 19, 2002. The contents of this application are incorporated herein by reference in their entirety.

BACKGROUND OF THE INVENTION

1. Field of the Invention

The present invention relates to a method for manufacturing a hair clipper blade.

2. Discussion of the Background

An edge cutting method using a grindstone 30, shown in FIGS. 22(*a*)–22(*c*), is conventionally known as one typical example of methods of manufacturing a hair clipper blade 1' for use in a manual or electric hair clipper. In FIG. 22(*a*), β denotes an angle of the grindstone 30 and $\theta_2$ denotes an edge cutting angle. Also, γ in FIG. 22(*b*) denotes an edge groove angle, and $\theta_3$ in FIG. 22(*c*) denotes a tip angle of a cutting edge portion 4.

To increase sharpness of the hair clipper blade 1', the edge cutting angle θ2 must be finished into an acuter angle. This solution, however, reduces the thickness of a remaining wall of a tip 4*a* and lowers the intensity of the hair clipper blade 1'. Another problem is that because the amount to be cut by the grindstone 30 is also increased, the life of the grindstone is shortened and the blade cost is pushed up.

In view of those problems, as another example of the related art, Japanese Unexamined Patent Application Publication No. 64-49596 discloses a hair clipper blade 1" in which, as shown in FIG. 23, a tip angle of the cutting edge portion 4 is formed in two steps as denoted by θ and θ' to increase both edge sharpness and tip strength. The contents of this application are incorporated herein by reference in their entirety.

SUMMARY OF THE INVENTION

According to one aspect of the present invention, a method for manufacturing a hair clipper blade includes providing a blank with a comb teeth shaped cutting edge portion, and forging the cutting edge portion to have an acute tip angle.

According to another aspect of the present invention, a method for manufacturing a hair clipper blade includes positioning a blank in a forward-feed mold. The blank is provided with a comb teeth shaped cutting edge portion. The blank with the cutting edge portion is moved to a next position. The cutting edge portion is forged to have an acute tip angle at the next position.

BRIEF DESCRIPTION OF THE DRAWINGS

A more complete appreciation of the invention and many of the attendant advantages thereof will become readily obtained as the same becomes better understood with reference to the following detailed description when considered in conjunction with the accompanying drawings, wherein:

FIG. 2(*b*) is a side sectional view of the electric hair clipper as shown in FIG. 2(*a*);

FIG. 4(*b*) is a plan view of the blade after forging;

FIG. 5(*b*) is a sectional view taken along a line V(b)—V(b) in FIG. 4(*b*);

FIG. 6(*b*) is a plan view of the blade after shaving according to the embodiment of the present invention;

FIG. 6(*c*) is a plan view of the blade after forging according to the embodiment of the present invention;

FIG. 7(*b*) is a sectional view taken along a line VII(b)—VII(b) in FIG. 6(*b*);

FIG. 7(*c*) is a sectional view taken along a line VII(c)—VII(c) in FIG. 6(*c*);

FIG. 8(*b*) is an explanatory view for explaining forging with a forging mold according to the embodiment of the present invention;

FIG. 9(*b*) is a plan view of the blade after forging according to the embodiment of the present invention;

FIG. 10(*b*) is a sectional view taken along a line X(b)—X(b) in FIG. 9(*b*);

FIG. 14(*b*) is an explanatory view for explaining a step of stamping from the half-stamped state into a fully stamped state according to the embodiment of the present invention;

FIG. 15(*b*) is a plan view of the blade in the fully stamped state according to the embodiment of the present invention;

FIG. 16(*b*) is a sectional view taken along a line XVI(b)—XVI(b) in FIG. 15(*b*);

FIG. 17 is a plan view of a blade after forging a cutting edge portion of a stationary blade except for a tip end portion thereof according to an embodiment of the present invention;

FIG. 18(*a*) is a sectional view taken along a line XVIII(a)—XVIII(a) in FIG. 17;

FIG. 18(*b*) is a sectional view taken along a line XVIII(b)—XVIII(b) in FIG. 17;

FIG. 18(*c*) is a sectional view taken along a line XVIII(c)—XVIII(c) in FIG. 17;

FIG. 19(*b*) is a plan view after cutting away the cutting edge portion according to the embodiment of the present invention;

FIG. 20(*b*) is a sectional view taken a line XX(b)—XX(b) in FIG. 19(*a*);

FIG. 20(*c*) is a sectional view taken along a line XX(c)—XX(c) in FIG. 19(*a*);

FIG. 20(*d*) is a sectional view taken along a line XX(d)—XX(d) in FIG. 19(*b*);

FIG. 20(*e*) is a sectional view taken along a line XX(e)—XX(e) in FIG. 19(*b*);

FIG. 21(*b*) is a side view of the forward-feed mold as shown in FIG. 21(*a*);

FIG. 22(*b*) is a plan view of a cutting edge portion;

FIG. 22(*c*) is a sectional view taken along a line XXII(c)—XXII(c) in FIG. 22(*b*)

DESCRIPTION OF THE EMBODIMENTS

Figure 1:
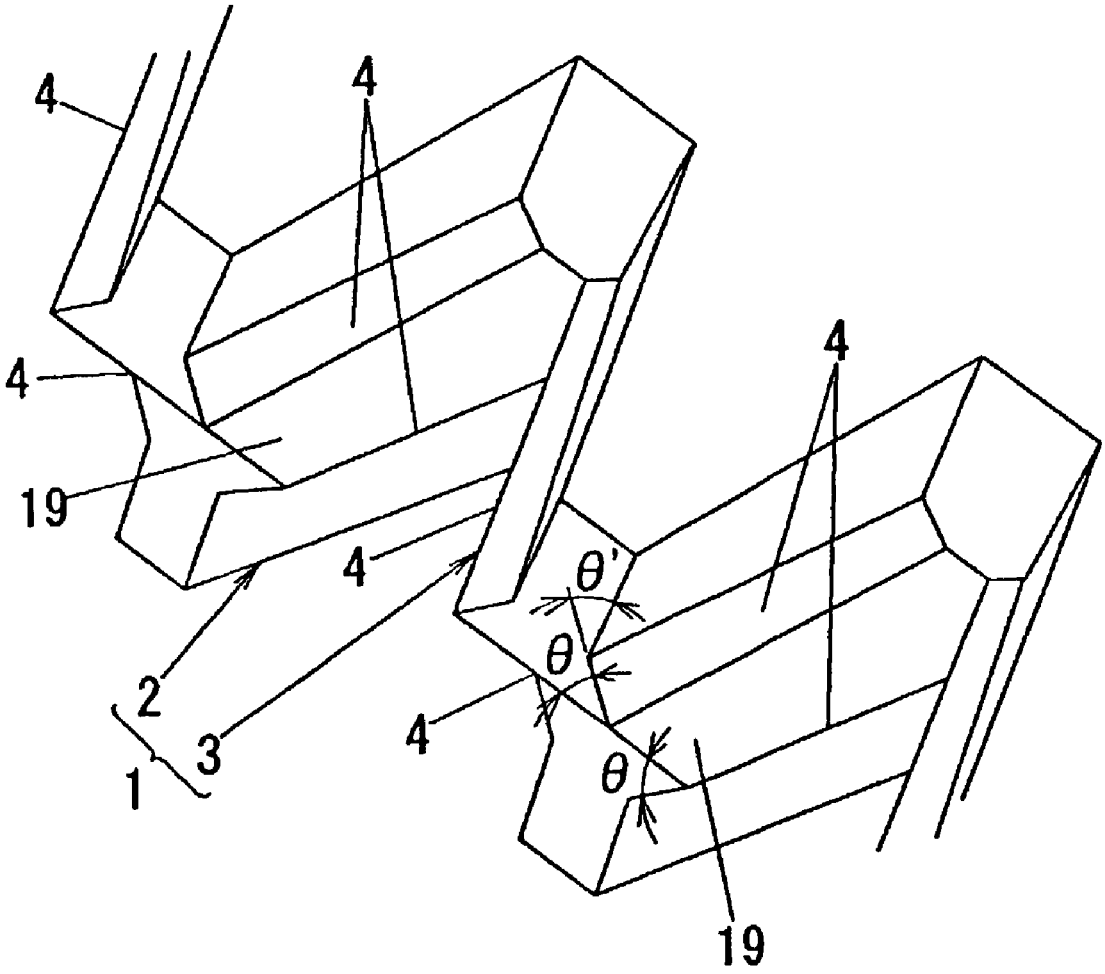
FIG. 1 is a perspective view of a stationary blade and a movable blade manufactured by a method according to one embodiment of the present invention.

The embodiments will now be described with reference to the accompanying drawings, wherein like reference numerals designate corresponding or identical elements throughout the various drawings.

Figure 2A:
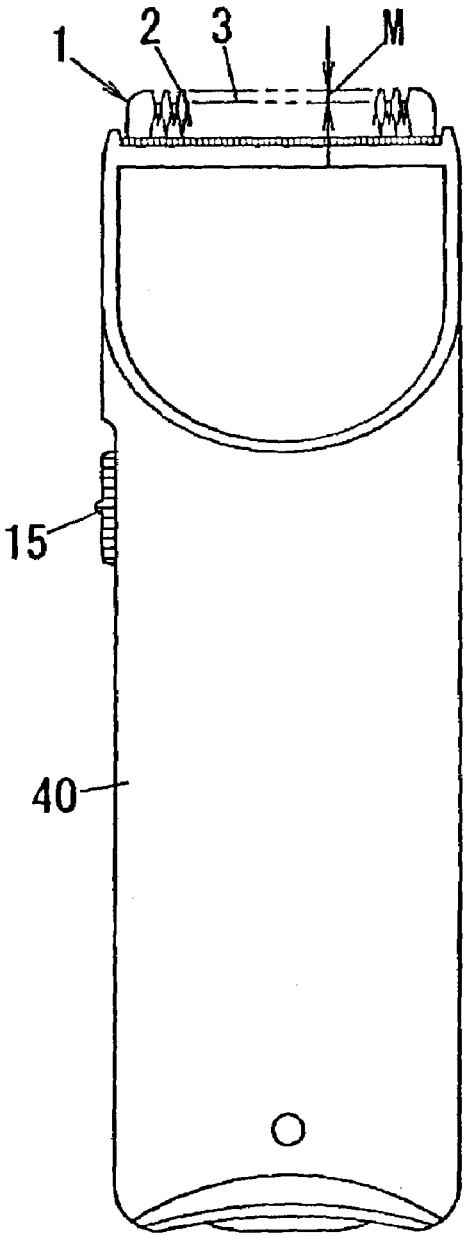
FIG. 2(*a*) is a front view of an electric hair clipper including the stationary blade and the movable blade as shown in FIG. 1.
Figure 2B:
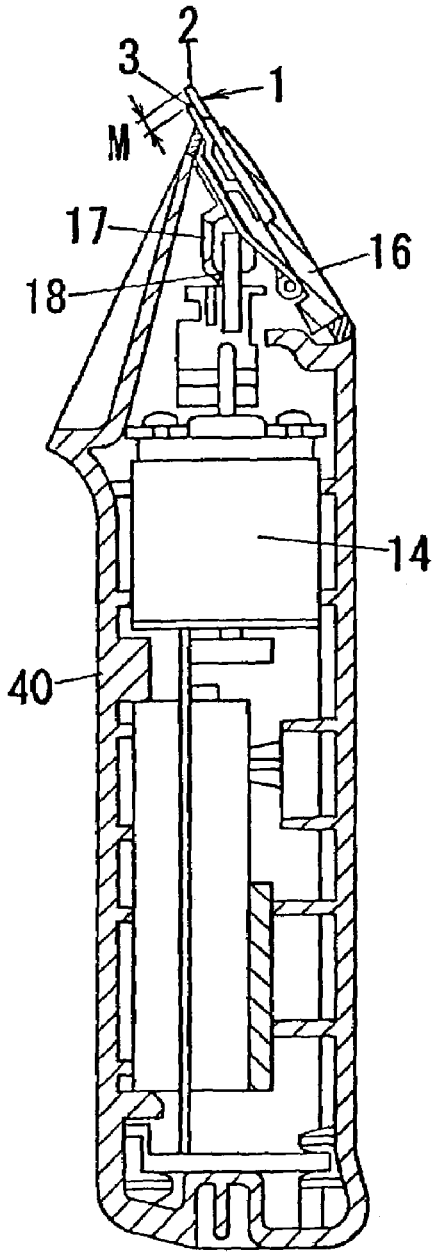

As shown in FIGS. 2(*a*), 2(*b*) and 3, an electric hair clipper according to an embodiment of the present invention includes a clipper body 40 which contains a motor 14, a power supply battery and an electric circuit. A hair clipper blade 1 which has a stationary blade 2 and a movable blade 3 each in the form of comb teeth is provided at a top of the body 40 as viewed in the drawings. A switch handle 15 is provided on a surface of the body 40. Upon operation of the switch handle 15, the movable blade 3 is reciprocally moved to cut hairs with comb teeth portions of both the stationary blade 2 and the movable blade 3. The stationary blade 2 and the movable blade 3 are made from, for example, a metal or an intermetallic compound.

The hair clipper blade 1 is constructed, as shown in FIGS. 2(*a*), 2(*b*) and 3, such that the movable blade 3 fixed to a guide plate 17 slides relative to the stationary blade 2 fixed to a stationary plate 16. Also, the movable blade 3 is properly positioned by a push-up spring 25 through the guide plate 17 and is pressed against the stationary blade 2 under a constant load. Further, the guide plate 17 is fitted over an eccentric shaft 18. Accordingly, the movable blade 3 is reciprocally moved sliding on the stationary blade 2 when the eccentric shaft 18 is rotated by the motor 14. Comparing only tip portions of the stationary blade 2 and the movable blade 3, as shown in FIG. 1, both blades have substantially the same shape.

Figures 4A, 4B:
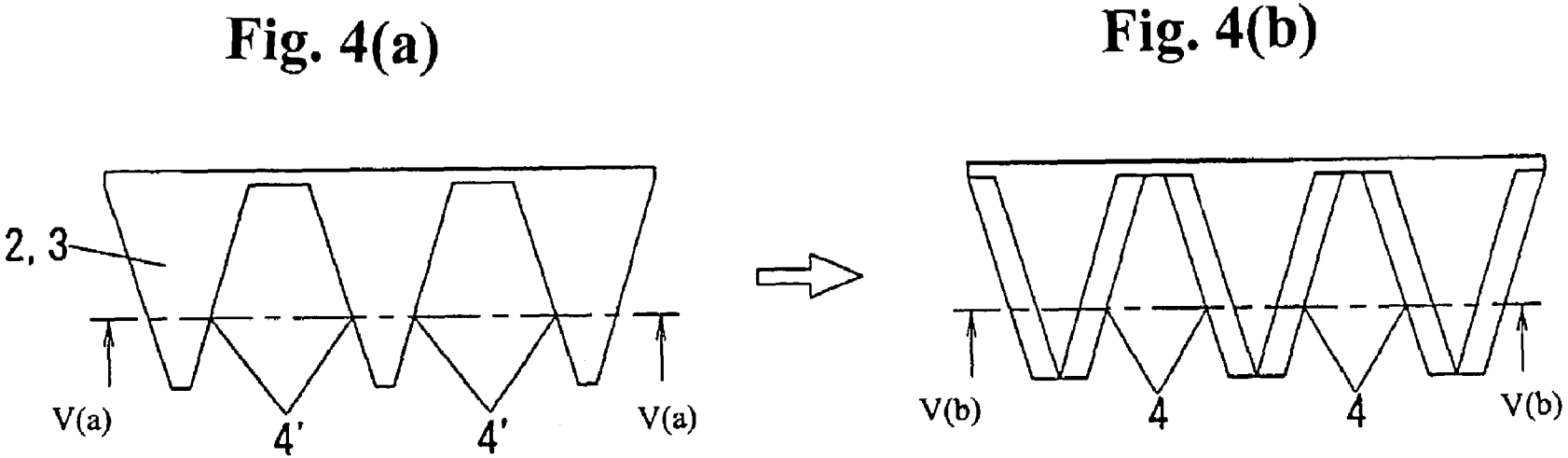
FIG. 4(*a*) is a plan view of a blade used in the electric hair clipper after press stamping.
Figure 5B:
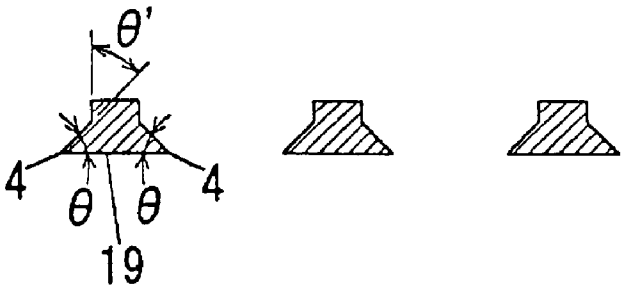
FIG. 5(*a*) is a sectional view taken along a line V(a)—V(a) in FIG. 4(*a*)
Figure 5A:
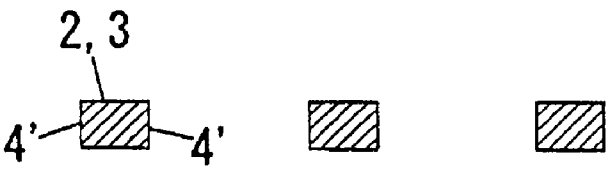

FIGS. 4(*a*) and 4(*b*) show one example of the method of manufacturing the hair clipper blade 1 according to an embodiment of the present invention. First, the comb teeth portions of the stationary blade 2 or the movable blade 3 of the hair clipper blade 1 are subjected to one of various types of primary processing, such as press stamping, edge cutting with a grindstone, or etching. A cutting edge portion 4' after the primary processing as shown in FIG. 4(*a*) has a cross-sectional shape that is, for example, substantially rectangular as shown in FIG. 5(*a*). Thereafter, the blade is subjected to secondary processing carried out as forging. The forging can be performed, for example, by a method using a punch and a die, etc. As a result of the secondary processing, as shown in FIGS. 4(*b*) and 5(*b*), a cutting edge portion 4 is finished to have a tip shape with an acute tip angle θ on the side of a sliding surface 19. By performing the primary processing and the secondary processing on each blank of the stationary blade 2 and the movable blade 3, the stationary blade 2 and the movable blade 3 shown in FIG. 1 can be obtained.

Thus, by shaping the cutting edge portion 4' into, for example, the substantially rectangular sectional form with the primary processing and then shaping the cutting edge portion 4 into an acute angle with the secondary processing carried out as forging, the cutting edge portion 4 is formed to have tip angles θ and θ' in two steps, whereby sharpness and strength of the cutting edge portion 4 are increased while improving a capability of introducing hairs between the movable blade 3 and the stationary blade 2. The acute tip angle θ makes it possible to reduce the cutting resistance when hairs are cut by the movable blade 3 and the stationary blade 2, and to cut the hairs at a relatively low torque with high efficiency. In addition, since forging is employed as the secondary processing, the hair clipper blade can be produced at an inexpensive cost and hardness of the tip can be greatly increased with an effect of increasing tenacity, which is specific to the forging, as compared with the related art in which a desired blade is shaped by sintering of a ceramic or the like. As a result, the hair clipper blade 1 ensuring satisfactory toughness and superior sharpness of the tip even after use for a long time can be easily produced. While in this embodiment the cutting edge portion 4 is formed to have the tip angles θ and θ' in two steps, the present invention is not limited to this embodiment, and the tip angle may be set in one step or in three or more steps. This is similarly applied to each of embodiments described below.

Figures 6A, 6B, 6C:
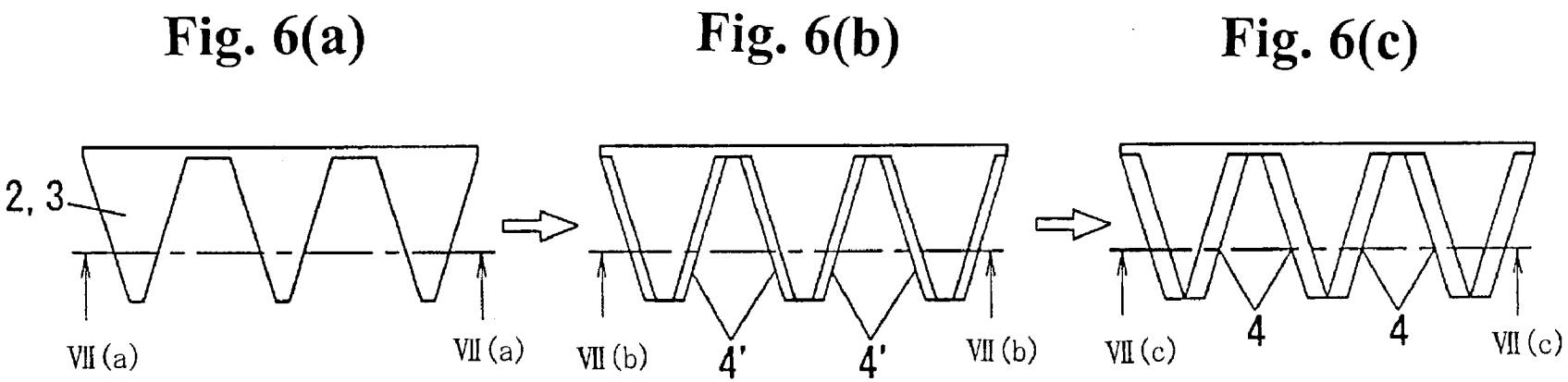
FIG. 6(*a*) is a plan view of a blade after press stamping according to an embodiment of the present invention.
Figure 7A:
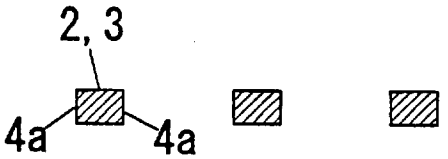
FIG. 7(*a*) is a sectional view taken along a line VII(a)—VII(a) in FIG. 6(*a*)
Figure 7B:
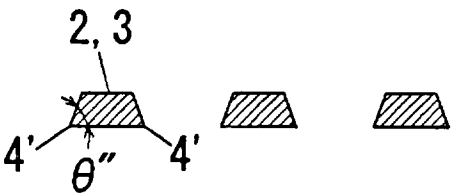
Figure 7C:
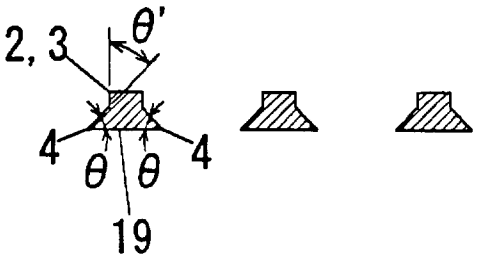

FIGS. 6(*a*), 6(*b*), 6(*c*), 7(*a*), 7(*b*) and 7(*c*) show another embodiment. In this embodiment, as shown in FIGS. 6(*a*) and 7(*a*), a blade blank is shaped by press stamping, for example, to have a tip shape in a substantially rectangular cross-section. Then, the blank is subjected to a shaving step to form a cutting edge portion 4' at a moderate slope (θ") between an edge groove portion 20 and a tip end portion 10 (see FIGS. 9(*a*) and 9(*b*)), as shown in FIGS. 6(*b*) and 7(*b*). The term "moderate slope" means an angle of smaller than 90°, but larger than the final tip angle θ. Subsequently, as shown in FIGS. 6(*c*) and 7(*c*), a cutting edge portion 4 is finished by forging to have a tip shape with an acute tip angle θ formed on the side of a sliding surface 19. Thus, the cutting edge portion 4 is formed to have tip angles θ and θ' in two steps, whereby sharpness and strength of the cutting edge portion 4 can be increased. Also, since the cutting edge portion 4' is given with the moderate slope beforehand by the shaving, it is possible to reduce the load imposed on a forging punch and a forging die in the forging step, and to prolong the life of a forging mold 6 (see FIGS. 8(*a*) and 8(*b*)). Note that the shaving step can be performed, for example, by a method of cutting the cutting edge portion 4 with a shaving cutter used for forming gears.

Figure 8B:
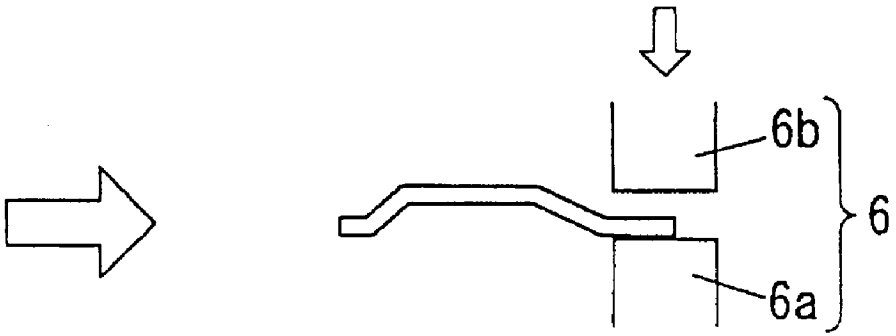
FIG. 8(*a*) is an explanatory view for explaining the case in which press stamping is performed with a stamping punch and a stamping die set in an oblique state according to an embodiment of the present invention.
Figure 8A:
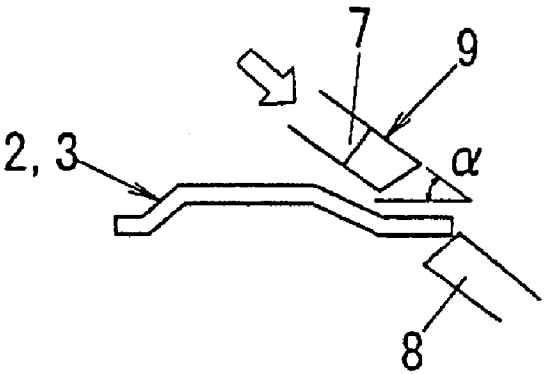
Figures 9A, 9B:
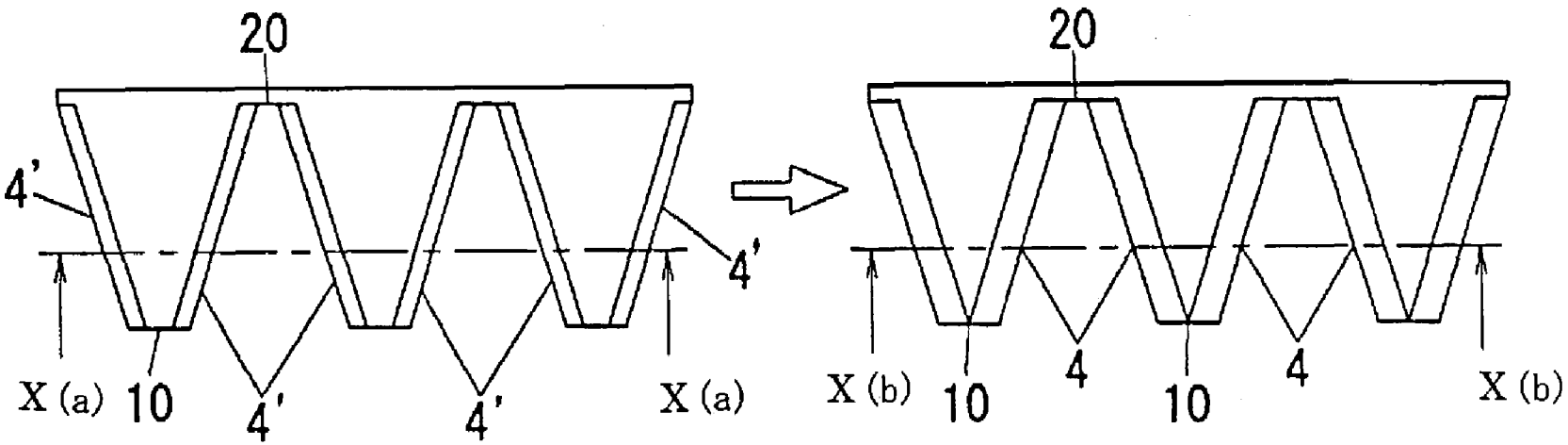
FIG. 9(*a*) is a plan view of a blade after press stamping according to an embodiment of the present invention.
Figure 11:
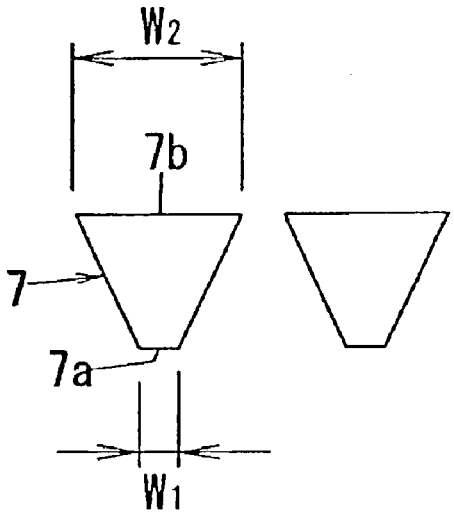
FIG. 11 is a front view of the stamping punch shown in FIG. 8.
Figure 12:
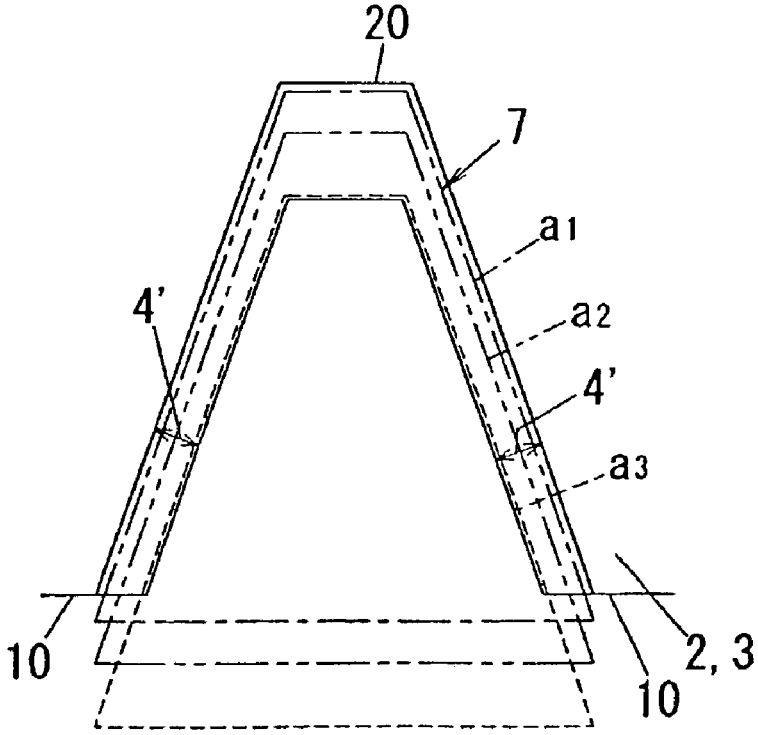
FIG. 12 is a plan view for explaining the case in which the stamping punch shown in FIG. 8 is driven to move at a predetermined inclination angle to obliquely stamp a cutting edge portion.
Figure 13:
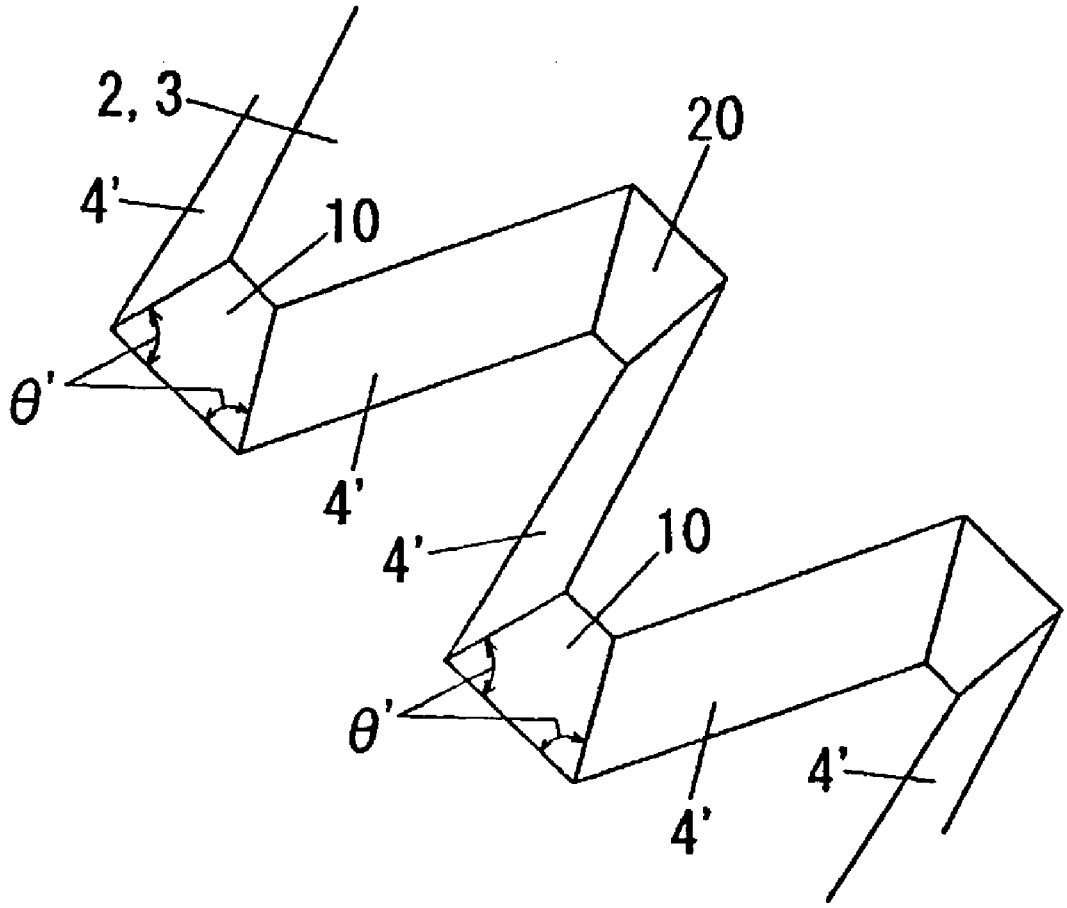
FIG. 13 is a perspective view showing the cutting edge portion after stamping performed by the stamping punch shown in FIG. 8.
Figure 22A:
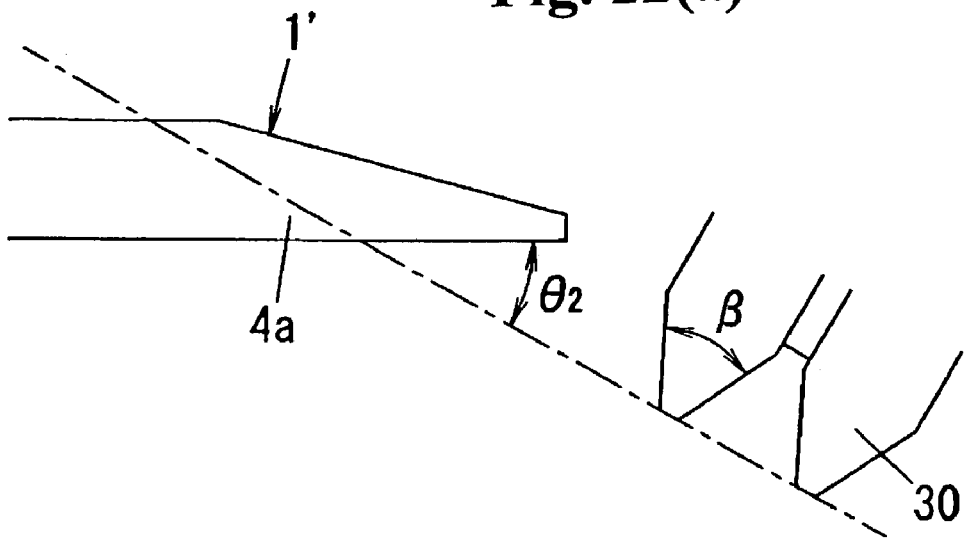
Fig. 22(a) BACKGROUND ART
FIG. 22(*a*) is an explanatory view for explaining one example of the related art in which edge cutting is performed with a grindstone.
Figure 22B:
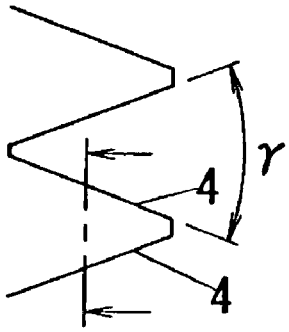
Figure 22C:
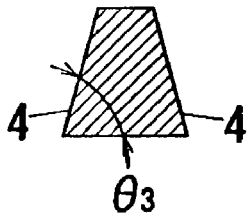
BACKGROUND ART Fig. 22(c)
Figure 23:
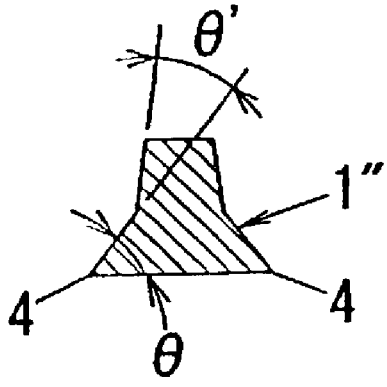
FIG. 23 is an explanatory view for explaining a tip sectional shape of a cutting edge portion of the related art.

FIGS. 8(*a*) to 13 represent another embodiment of the present invention in which the primary processing is performed in a different way, and show one example of the case of forming the edge of the stationary blade 2 or the movable blade 3 by stamping with a press mold 9. The secondary processing with forging is performed in the same manner as in the above-described embodiment. In this embodiment, the primary processing is performed using a stamping punch 7 (FIG. 11) having such a tapered cross-sectional shape that a width $W_1$ of a punch lower surface 7*a* positioned to face a blade surface to be stamped is narrower than a width $W_2$ of a punch upper surface 7*b*, and a stamping die 8 (FIG. 8(*a*)) which is engaged with the stamping punch 7 while leaving a predetermined clearance between them and which cooperates with the stamping punch 7 for stamping of a blade blank. An inclination angle $\alpha$ of the stamping punch 7 is substantially equal to the edge cutting angle of the grindstone in the edge cutting step in the related art (shown in FIG. 22(*a*)). Also, as shown in FIG. 12, the stamping punch 7 has a horizontal sectional shape tapered in match with the edge groove angle. In operation, the stamping punch 7 and the stamping die 8 are first set obliquely relative to the blade surface to be stamped, as shown in FIG. 8(*a*). Then, the stamping punch 7 is driven to move in an oblique direction while the punch distal end is oriented obliquely downward. This operation for driving the stamping punch 7 in an oblique posture can be easily realized by employing a linkage mechanism or the like.

Figure 10B:
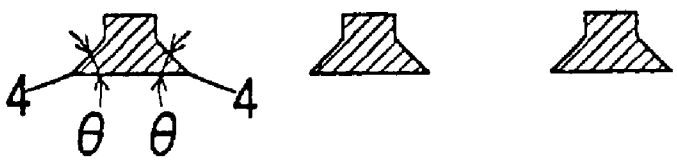
FIG. 10(*a*) is a sectional view taken along a line X(a)—X(a) in FIG. 9(*a*)
Figure 10A:
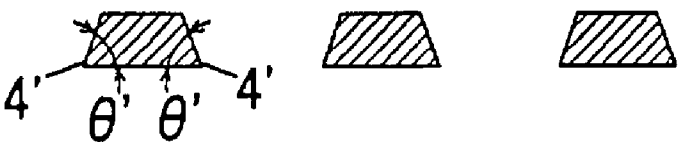

On that occasion, with the stamping punch 7 driven in an oblique posture, the position of the stamping punch 7 viewing from above is gradually moved in an order of a one-dot-chain line $a_1$, a two-dot-chain line $a_2$ and a broken line $a_3$ in FIG. 12 so as to perform the stamping of the cutting edge portion 4' in a direction from the edge groove portion 20 toward the tip end portion 10. The cutting edge portion 4 is thereby given with a moderate slope ($\theta'$) as shown in FIGS. 10(*a*) and 13. The term "moderate slope" means an angle of smaller than 90°, but larger than the final tip angle $\theta$. Subsequently, as shown in FIG. 8(*b*), forging is performed using a forging punch 6*a* and a forging die 6*b*. At this time, by driving the forging punch 6*a* to move vertically, the cutting edge portion 4 is forged to have a tip shape with an acute tip angle $\theta$ ($<\theta'$) as shown in FIG. 10(*b*). Thus, by setting the stamping punch 7 and the stamping die 8 in an oblique state in the first press-stamping step, the moderate slope can be given to the tip shape of the cutting edge portion 4 at the same time as the stamping, and the cutting edge portion 4 can be more easily shaped into the acute tip angle $\theta$ in the subsequent forging step. In other words, it is possible to reduce the load imposed on the forging mold 6 (i.e., the forging punch 6*a* and the forging die 6*b*) in the forging step, and to prolong the life of the forging mold 6.

Figure 14B:
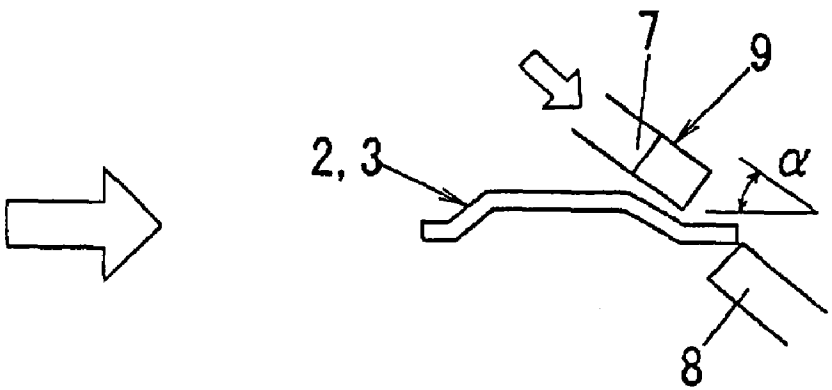
FIG. 14(*a*) is an explanatory view for explaining the case in which the stamping punch is driven to move at a predetermined inclination angle to bring a cutting edge portion into a half-stamped state according to an embodiment of the present invention.
Figure 14A:
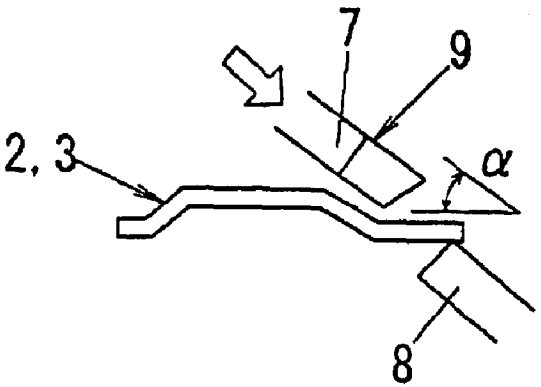
Figure 15A:
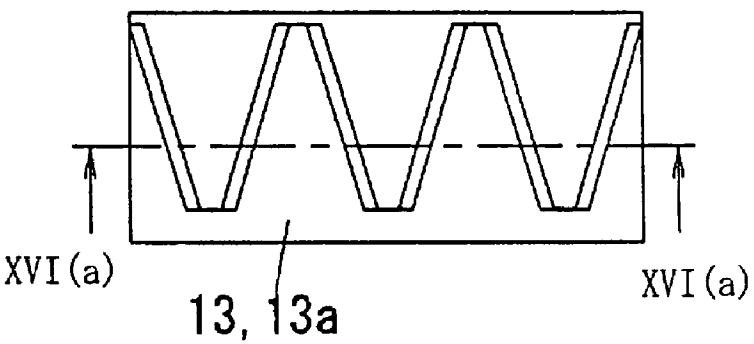
FIG. 15(*a*) is a plan view of a blade in the half-stamped state according to an embodiment of the present invention.
Figure 15B:
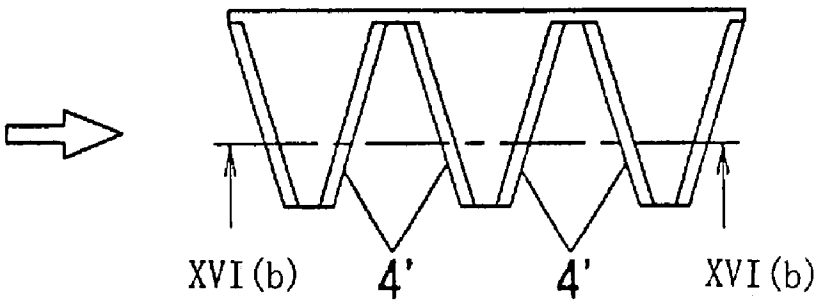
Figure 16B:
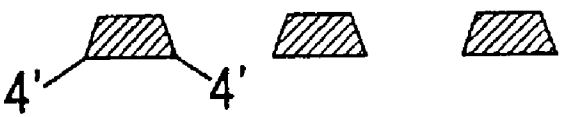
FIG. 16(*a*) is a sectional view taken along a line XVI(a)—XVI(a) in FIG. 15(*a*)
Figure 16A:
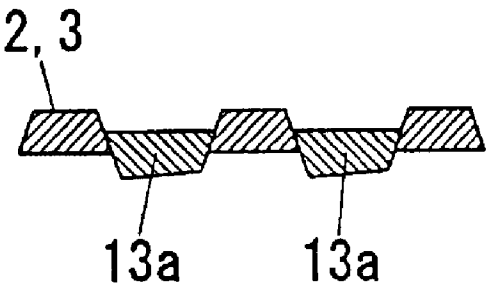

FIGS. 14(*a*) to 16 show an example of the case of performing the stamping step shown in FIGS. 8(*a*) and 8(*b*) in two or more stages, in which the stamping punch 7 and the stamping die 8 are obliquely set at the predetermined angle $\alpha$. A stamping step of this example, shown in FIGS. 14(*a*) and 14(*b*), are basically similar to that shown in FIG. 8(*a*) and hence a description is made of only different points. When stamping a flat plate blank 13 in the stamping step of this example, the stamping punch 7 and the stamping die 8 are adjusted in a first stage such that the blank 13 is not fully stamped, but half stamped as shown in FIGS. 15(*a*) and 16(*a*). This first half-stamping is not limited to once, but it may be performed in two ore more times. Subsequently, as shown in FIGS. 15(*b*) and 16(*b*), second half-stamping is performed to fully stamp out useless portions 13*a* from the blank in the half-stamped state. With this method, the load imposed on the stamping punch 7 and the sampling die 8 in one stamping step can be reduced and hence the life of a press mold 9 can be prolonged. Further, no stamping chips are produced in the first half-stamping step, and large-sized stamping chips are produced in the last stamping step. Thus, since the necessity of removing stamping chips produced in the press mold 9 during the stamping step is eliminated, this method is free from a failure in removing the stamping chips, and the mold can be prevented from suffering damages caused by the failure in removing the stamping chips.

Figure 3:
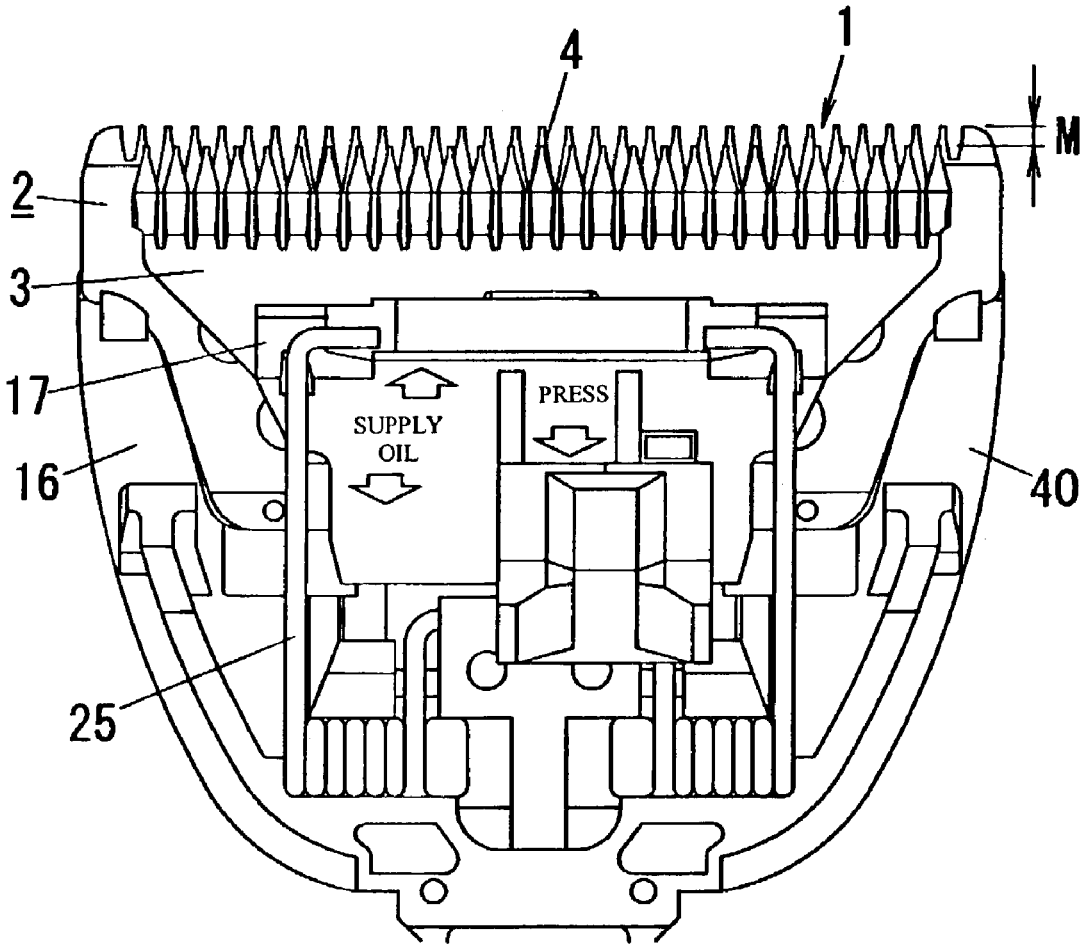
FIG. 3 is a plan sectional view of the electric hair clipper as shown in FIG. 2(*a*)

FIGS. 17 and 18(*a*)–18(*c*) show one example of the case in which, when forging the stationary blade 2, the forging is performed on a cutting edge portion 4 of the stationary blade 2 except for a tip end portion 10 thereof. In this example, as shown in FIG. 17, the stationary blade 2 is subjected to the forging to have an acute tip angle in an area except for the tip end portion 10 and an edge groove portion 20. In this case, the tip end portion 10 and the edge groove portion 20 are not finished to have the acute tip angles. However, the tip end portion 10 and the edge groove portion 20 do not take part in cutting hairs when a hair clipper blade 1 is assembled, and therefore cutting performance of the hair clipper blade 1 does not deteriorate even with those portions 10 and 20 not having the acute tip angles. More specifically, for the purpose of protecting the skin from being hurt when cutting hairs, the hair clipper blade 1 is assembled, as shown in FIGS. 1 to 3, such that the tip end portion 10 of the stationary blade 2 is positioned to project from the tip end portion 10 of the movable blade 3 by a certain step difference M. Also, the edge groove portion 20 of the stationary blade 2 is positioned such that the hairs are cut by the movable blade 3 before reaching the edge groove portion 20 of the stationary blade 2. For those reasons, the cutting performance does not deteriorate. In consideration of the above, only a central area of the cutting edge portion 4 of the stationary blade 2, which most greatly affects the cutting performance, is subjected to the forging to have the acute tip angle. This eliminates the necessity of forging the tip end portion 10 having a narrow width, and the mold (such as the punch) used for the forging is not required to have a narrow portion corresponding to the narrow tip end portion. Consequently, the forging mold is prevented from suffering damages such as chipping (minute breaking).

Figure 19A:
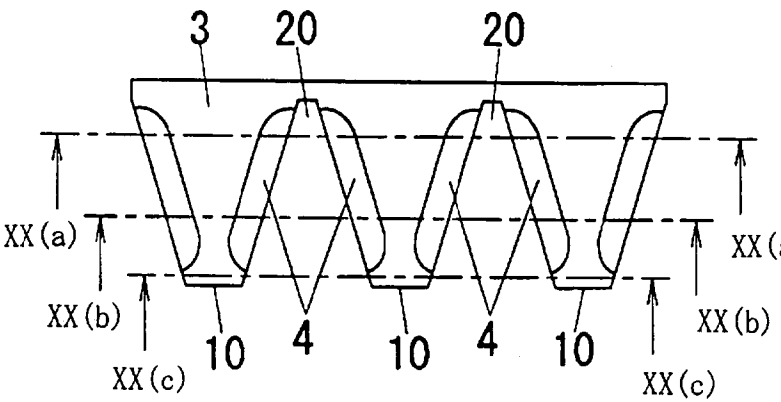
FIG. 19(*a*) is a plan view of a blade after forging a cutting edge portion of a movable blade except for a tip end portion thereof according to an embodiment of the present invention.
Figure 19B:
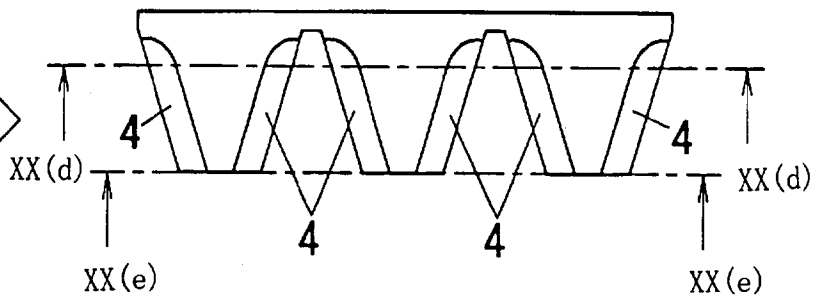
Figure 20A:
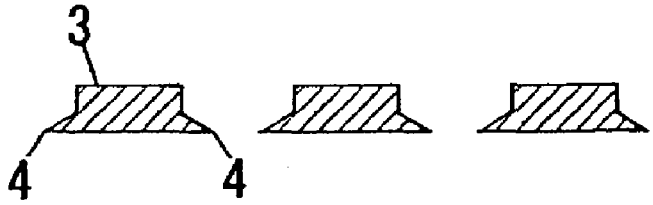
FIG. 20(*a*) is a sectional view taken along a line XX(a)—XX(a) in FIG. 19(*a*)
Figure 20B:
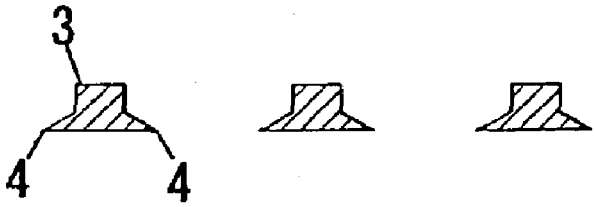
Figure 20C:
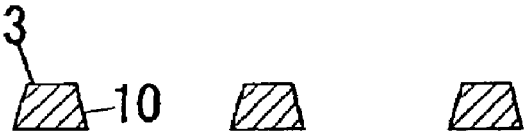
Figure 20D:
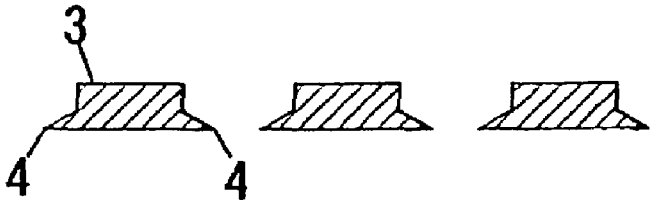
Figure 20E:
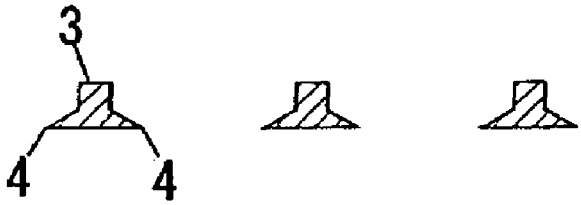

FIGS. 19(*a*)–19(*b*) and 20(*a*)–20(*e*) show one example of the case in which, when forging the movable blade 3, the forging is performed on a cutting edge portion 4 of the movable blade 3 except for a tip end portion 10 thereof, and the tip end portion 10 is cut away in a subsequent cutting step. In this example, as shown in FIGS. 19(*a*) and 20(*a*) to 20(*c*), the movable blade 3 is subjected to the forging only in an area except for the tip end portion 10 and an edge groove portion 20 of the cutting edge portion 4 similarly to the forging step for the stationary blade 2 in the just above embodiment. Subsequently, as shown in FIGS. 19(*b*), 20(*d*) and 20(*e*), the area of the movable blade 3 corresponding to the tip end portion 10, which has not been subjected to the forging, is cut away, whereupon the cutting edge portion 4 having been forged into the acute tip angle θ is formed by being left in place. Thus, the cutting edge portion 4 of the movable blade 3, which greatly affects cutting characteristics, can be formed so as to have the acute tip angle.

Figure 21A:
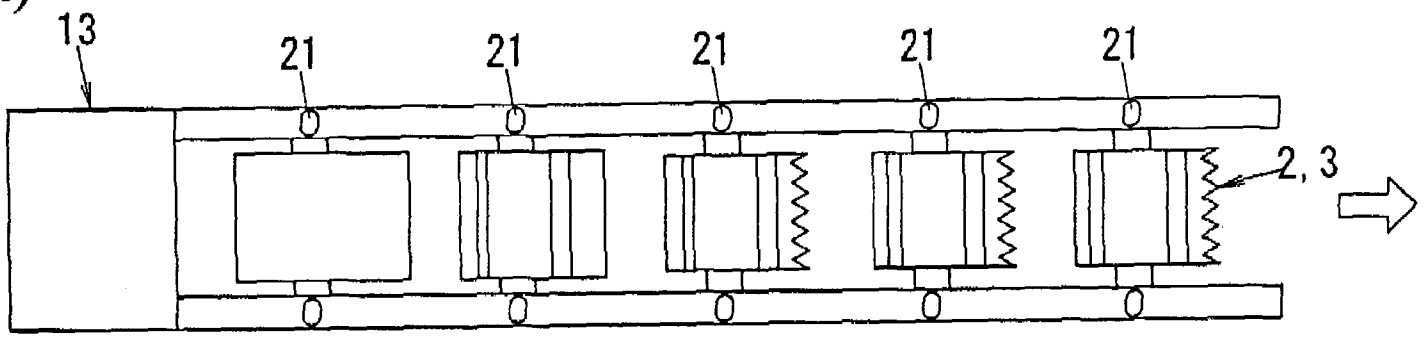
FIG. 21(*a*) is a plan view for explaining the case of performing an outer contour stamping step, a bending step, a stamping step, and a forging step on a flat plate blank in sequence within a forward-feed mold according to an embodiment of the present invention.
Figure 21B:
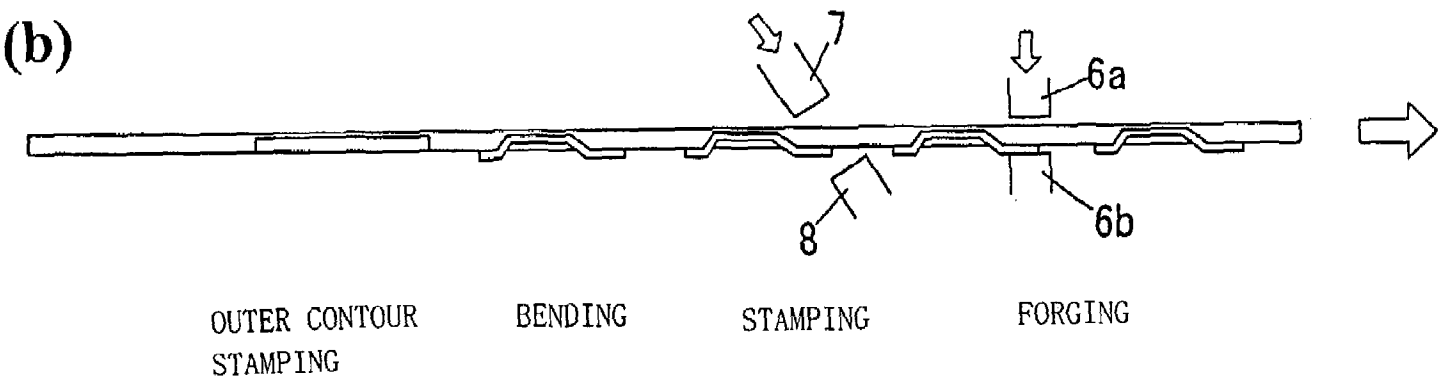

FIGS. 21(*a*) and 21(*b*) show one example of the case in which primary processing, e.g., press stamping, and secondary processing with forging are performed in sequence while a flat plate blank 13 is precisely positioned with the aid of pilot holes 21 and is successively moved in a forward-feed mold (not shown), thereby producing the desired shape of the hair clipper blade 1. In this example, an outer contour stamping step, a bending step, a stamping step, and a forging step are disposed within the forward-feed mold in the order named. Each of those steps is performed in a state in which the flat plate blank 13 is precisely positioned with the aid of the pilot holes 21. Accordingly, since the flat plate blank 13 is prevented from displacing out of the desired position when it is fed through a series of forming steps, the final shape of the hair clipper blade 1 can be obtained from the flat plate blank 13 in the same mold with good accuracy, and the hair clipper blade 1 can be easily and inexpensively produced. In addition, since each processing step can be performed while precisely positioning the flat plate blank with the aid of the pilot holes 21, stable processing accuracy can be achieved and product quality can be improved.

According to an embodiment of the present invention, in a hair clipper blade for cutting hairs by a comb teeth-like stationary blade and a movable blade driven to reciprocally move while sliding in contact with the stationary blade, a cutting edge portion is formed in a comb teeth shaped tip of the stationary blade or the movable blade by primary processing, such as press stamping, edge cutting with a grindstone, or etching, and the cutting edge portion is shaped by secondary processing carried out as forging to have an acute tip angle. Thus, since the cutting edge portion is shaped into an acute tip angle by forging after roughly shaping the cutting edge portion by the primary processing, a hair clipper blade ensuring sufficient tip strength and having good cutting characteristics can be produced at a relatively inexpensive cost by the utilization of forging.

According to an embodiment of the present invention, the cutting edge portion is subjected to shaving between the primary processing and the secondary processing. Therefore, the cutting edge portion can be given with a moderate slope by the shaving. After the shaving, the cutting edge portion is forged to have the acute tip angle, whereby the load imposed on a forging mold used in the secondary processing can be reduced and the life of the forging mold can be prolonged.

According to an embodiment of the present invention, when stamping a blade blank of the stationary blade or the movable blade in the primary processing, the process includes the steps of using a stamping punch having such a tapered cross-sectional shape that a width of a punch lower surface positioned to face a blade surface to be stamped is narrower than a width of a punch upper surface, and a stamping die which is engaged with the stamping punch while leaving a predetermined clearance therebetween and which cooperates with the stamping punch for stamping of the blade blank; obliquely setting the stamping punch and the stamping die relative to the blade surface to be stamped; driving the stamping punch to move at a predetermined inclination angle, thereby giving a moderate slope to the cutting edge portion; and then shaping the cutting edge portion by the secondary processing carried out as forging. Therefore, the stamping step and the step of giving the moderate slop to the cutting edge portion can be both performed in the primary processing at the same time. Further, by giving the moderate slope to the cutting edge portion beforehand, the cutting edge portion can be easily shaped into the acute tip angle in the subsequent forging step. As a result, the load imposed on the forging mold used in the secondary processing can be reduced and the life of the forging mold can be prolonged.

According to an embodiment of the present invention, the press-stamping step is performed in two or more stages for stamping the blade blank with the stamping punch and the stamping die set in an oblique state, and the cutting edge portion is then shaped by forging to have the acute tip angle. Therefore, since the stamping step for forming the tip shape is performed in plural stages in the primary processing, the load imposed on the press mold used in the stamping step can be reduced and the life of the press mold can be prolonged. Also, with the provision of a half-stamping step, no stamping chips are produced in the half-stamping step, and large-sized stamping chips are produced in the last stamping step. Thus, since the necessity of removing stamping chips produced in the press mold during the stamping step is eliminated, operation failures are reduced and the mold can be prevented from suffering damages caused by the failure in removing the stamping chips.

According to an embodiment of the present invention, in the step of forging the stationary blade, the forging is performed on the cutting edge portion of the stationary blade except for a tip end portion thereof. Therefore, the following advantages are obtained. When the stationary blade and the movable blade are assembled into the hair clipper blade, the tip end portion of the stationary blade does not take part in cutting hairs for the purpose of protecting the skin from being hurt when cutting hairs, and therefore cutting performance of the hair clipper blade does not deteriorate even with the tip end portion not having the acute tip angle. Accordingly, by forging only an area of the cutting edge portion, which most greatly affects the cutting performance, except for the tip end portion so as to have the acute tip angle, the necessity of forging the tip end portion having a narrow width is eliminated, and the mold (such as the punch) used for the forging is not required to have a narrow portion corresponding to the narrow tip end portion. Consequently, the forging mold is prevented from suffering damages such as chipping (minute breaking).

According to an embodiment of the present invention, in the step of forging the movable blade, the forging is performed on the cutting edge portion of the movable blade except for a tip end portion thereof, and the tip end portion is cut away in a subsequent cutting step. Therefore, the following advantages are obtained. An area of the cutting edge portion, which most greatly affects the cutting performance, except for the tip end portion can be forged to have the acute tip angle, and the necessity of forging the tip end portion having a narrow width is eliminated. In addition, since the tip end portion not forged into the acute tip angle is removed, good cutting characteristics can be ensured.

According to an embodiment of the present invention, the shape of the hair clipper blade is obtained by moving a flat plate blank within a forward-feed mold while holding the blank in a precisely positioned state, and by successively performing the primary processing and the secondary processing. Therefore, the final shape of the hair clipper blade can be obtained from the flat plate blank in the same mold. Furthermore, since each processing step is performed while precisely positioning the flat plate blank, a hair clipper blade having high quality can be easily and inexpensively produced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for manufacturing a hair clipper blade, comprising:

providing a blank with a comb teeth shaped cutting edge portion; and forging the cutting edge portion to have an acute tip angle.

2. A method according to claim 1, wherein the blade is formed from metal or intermetallic compound.

3. A method according to claim 1, wherein said providing step is performed by press stamping, edge cutting with a grindstone, or etching.

4. A method according to claim 1, wherein said forging is performed by using a punch or a die.

5. A method according to claim 1, wherein, in said providing step, a cross-sectional shape of the cutting edge portion is formed to be substantially rectangular.

6. A method according to claim 1, further comprising:

shaving the cutting edge portion to have an angle larger than the acute tip angle after the providing step.

7. A method according to claim 6, wherein said shaving is performed by using a shaving cutter.

8. A method according to claim 1, wherein a hair clipper blade including a stationary blade and a movable blade is manufactured.

9. A method according to claim 1, wherein the providing step comprising:

providing a stamping punch having a tapered cross-sectional shape that has a width of a punch lower surface positioned to face a surface of the blank to be stamped and a width of a punch upper surface that is larger than that of the punch lower surface;

providing a stamping die which is configured to be engaged with the stamping punch having a predetermined clearance between the stamping die and the stamping punch;

setting the stamping punch and the stamping die obliquely relative to the surface of the blank to be stamped; and moving the stamping punch obliquely relative to the surface of the blank to be stamped to provide the cutting edge portion with an angle larger than the acute tip angle.

10. A method according to claim 9, wherein the setting step and the moving step are performed at least twice to form the cutting edge portion with the angle larger than the acute tip angle.

11. A method according to claim 8, wherein the cutting edge portion of the stationary blade except for a tip end portion of the stationary blade is forged.

12. A method according to claim 8, wherein the cutting edge portion of the movable blade except for a tip end portion of the movable blade is forged and wherein the tip end portion is cut off.

13. A method for manufacturing a hair clipper blade, comprising:

positioning a blank in a forward-feed mold;

providing the blank with a comb teeth shaped cutting edge portion;

moving the blank with the cutting edge portion to a next position; and forging the cutting edge portion to have an acute tip angle at the next position.

14. A method for manufacturing a hair clipper blade, comprising:

a step for providing a blank with a comb teeth shaped cutting edge portion; and a step for forging the cutting edge portion to have an acute tip angle.

* * * * *